US007008038B2

(12) United States Patent
Takagi et al.

(10) Patent No.: US 7,008,038 B2
(45) Date of Patent: Mar. 7, 2006

(54) INK-JET PRINTING APPARATUS, METHOD OF FILLING LIQUID IN INK-JET HEAD THEREOF, APPARATUS FOR MANUFACTURING MICRO-ARRAY AND METHOD OF FILLING LIQUID IN EJECTION HEAD THEREOF

(75) Inventors: Fumio Takagi, Chino (JP); Ryuichi Kurosawa, Okaya (JP)

(73) Assignee: Seiko Epson Corporation, (JP)

( * ) Notice: Subject to any disclaimer, the term of this patent is extended or adjusted under 35 U.S.C. 154(b) by 6 days.

(21) Appl. No.: 10/630,222

(22) Filed: Jul. 30, 2003

(65) Prior Publication Data

US 2004/0075710 A1 Apr. 22, 2004

(30) Foreign Application Priority Data

Aug. 2, 2002 (JP) ..... 2002-225589

(51) Int. Cl.
*B41J 2/165* (2006.01)

(52) U.S. Cl. ..... 347/29; 347/30; 347/32

(58) Field of Classification Search ..... 347/22, 347/29, 30, 31, 32, 33
See application file for complete search history.

(56) References Cited

U.S. PATENT DOCUMENTS 4,998,115 A * 3/1991 Nevarez et al. ..... 347/35
5,572,243 A * 11/1996 Hermanson ..... 347/29
5,984,450 A * 11/1999 Becker et al. ..... 347/24
6,372,483 B1 * 4/2002 Schleifer et al. ..... 435/287.1

FOREIGN PATENT DOCUMENTS

JP 2001-186880 7/2001

* cited by examiner

*Primary Examiner*—Shih-Wen Hsieh
(74) *Attorney, Agent, or Firm*—Harness, Dickey & Pierce, P.L.C.

(57) ABSTRACT

In a method of filling an ink-jet head of an ink-jet type printing apparatus with a liquid stored in an ink cartridge or in a reservoir tank, the head is filled up to the tip of nozzles by bringing a suction cap into close contact with a nozzle opening face of the ink-jet head via a gas-permeable filters and drawing the air inside the suction caps with a pump.

4 Claims, 8 Drawing Sheets

METHOD OF FILLING A LIQUID IN THIS INVENTION

CONVENTIONAL METHOD OF FILLING A LIQUID SUCTION

METHOD OF FILLING A LIQUID IN THIS INVENTION

INK-JET PRINTING APPARATUS, METHOD OF FILLING LIQUID IN INK-JET HEAD THEREOF, APPARATUS FOR MANUFACTURING MICRO-ARRAY AND METHOD OF FILLING LIQUID IN EJECTION HEAD THEREOF

BACKGROUND OF THE INVENTION

1. Field of the Invention

The invention relates to a printing apparatus using an ink-jet head and a method of filling an ink-jet head with a liquid. More particularly, it relates to an apparatus for manufacturing a micro-array, which prints liquid spots of many kinds in very small volumes, like an apparatus for manufacturing a micro-array of DNA, proteins, etc. and a method of filling an ejection head thereof with a liquid.

2. Related Art

Ink-jet type printing apparatuses are in wide and general use as ink-jet printing apparatuses. Some of the advantages of ink-jet printing apparatuses are that ink-jet heads can be made small and with high density, that they can place small volumes of liquid drops at desired locations with high precision, that they are unaffected by the type or properties of the ejected liquid, that they can be used for printing on arbitrary media besides paper, including film, fabric, glass plate, synthetic resin substrate, and metal plate, that they make little noise while printing, and that they are inexpensive.

For these reasons, ink-jet technologies have received much attention in recent years for applications in many sectors besides the main sector of printing, for example, manufacturing DNA chips (also called DNA micro-arrays). Here, 'DNA chips' means, for example, chips on which solutions containing several thousand or several tens of thousands of DNA fragments have been attached in a matrix pattern to a substrate, for example, slide glass, for genetic classification or analysis.

Ink-jet printing apparatuses and other apparatuses require filling (priming) the all nozzles of ink-jet heads or ejection heads with a liquid to be ejected (ink, etc.).

Conventionally, such priming is carried out in ink-jet printing apparatuses by the method of evacuating the ink chamber via nozzle opening faces, a suction cap brought into close contact with the nozzle opening faces on the ink-jet head, and pumping the air out.

However, since it is difficult to detect when each nozzle has been completely filled with ink, suction time of the pump is extended somewhat. As a result, some ink is wasted because it is released from the nozzle tip.

A method of manufacturing a DNA chip by the ink-jet method is also disclosed in, for example, Japanese Laid-Open under the Public No. 2001-186880, but that patent has two problems: first, that it applies to filling nozzles all the way up to the tip with very small volumes of biopolymer solutions; and second, that a small volume of the expensive biopolymer solution is wastefully discarded when used in the same method for priming as in conventional ink-jets.

SUMMARY OF THE INVENTION

Therefore, the objective of this invention is to propose an ink-jet printing apparatus, an apparatus for manufacturing a micro-array and a method in which their ejection heads are completely filled with liquids to be ejected by the ink-jet method without wasted release of the liquids.

A method of filling a liquid in an ink-jet head with a liquid according to the present invention, is to fill a ink-jet head of a printing apparatus with a liquid which is stored in a tank, wherein a suction cap is brought into close contact with a nozzle opening surface of the ink-jet head with intervention of a gas-permeable filter and air within the suction cap is suctioned so as to fill the whole of the nozzle up to the tip thereof.

Here, it is preferable for the gas-permeable filter to allow a gas to pass through but not a liquid to pass through under a pressure below a certain level, and to be made of, for example, fine polytetrafluoroethylene fibers, and to have a mean pore diameter of 1 to 3 $\mu$m.

When the liquid from inside of the tank through the gas-permeable filter is drawn at the nozzle opening face (or equivalently, the head tip mating face), the gas-permeable filter allows the air but not the liquid to pass through, so the ejection liquid in the tank is stopped at the nozzle tip. Consequently, it is possible to fill all the flow path in the ejection head (ink-jet head) up to the tip with the ejection liquid. It is also possible to completely remove air bubbles from the interior. Thus, there is no waste of extra liquid during priming.

Also, the numerical limits on the mean hole diameter in the gas-permeable filter are mainly determined by the loss of ability to block liquid at the upper limit, and by excess process time due to delay in evacuation at the lower limit.

The filling with a liquid is performed after the ink-jet head has been moved to a non-ejection region outside the printing region. In other words, priming is accomplished while the carriage carrying the ejection head (ink-jet head) is in the home position.

The gas-permeable filter is applied so as to cover the entire nozzle opening faces of the all the nozzles, and suction is applied.

It is essential for the gas-permeable filter to be brought into close contact with the opening faces of all the nozzles of the ejection heads (ink-jet heads). If there is a gap between the two components, there is a risk that the ejection liquid will adhere to the edges of the nozzle opening and affect the ejection performance.

An ink-jet printing apparatus of the present invention contains a tank for supplying a liquid to be ejected to the ejection head of an ink-jet printing apparatus, and comprises suction means, forced to be in close contact with a nozzle opening surface, including a suction cap with a gas-permeable filter, and a pump connected to the suction cap.

Here, also, the gas-permeable filter allows a gas to pass through but not a liquid under the pressure below a certain level. It is made of, for example, fine polytetrafluoroethylene fibers, and has a mean pore diameter of 1 to 3 $\mu$m.

The unit including the suction means or the suction caps can be moved to a non-ejection region outside the printing region and raised or lowered.

The suction means may be of unitary construction; in that case, the entire unit must be capable of being raised or lowered. Alternatively, the suction cap assembly may be constructed to be raised or lowered without the pump.

The gas-permeable filter is constructed as to be brought into close contact with and cover throughout the nozzle opening faces on the ink-jet heads.

One example of the construction for bringing the gas-permeable filter into contact is placement of a permeable, elastic sheet between the suction cap and nozzle opening face.

In a method of filling an ejection head of an apparatus for manufacturing a micro-array according to the present invention, the ejection head of the apparatus for manufacturing a micro-array by an ink-jet method is filled with a liquid stored in a tank by using any one of the above-mentioned methods.

The previously mentioned method of filling an ink-jet head with a liquid can also be used in the micro-array manufacturing apparatus. Therefore, by inserting an gas-permeable filter between the nozzle opening face and the suction cap in close contact, and activating suction, it is possible to fill the nozzle up to its tip with a liquid, which is used in very small quantities but is very expensive (for example, solutions of biological molecules which are used in the manufacture of DNA chips), without waste of the liquid.

Here, 'micro-array' means an array of several thousand to several tens of thousands of probe samples of DNA, protein or other materials on a glass or other substrate. A DNA micro-array (also called a 'DNA chip') is a representative example of this.

'DNA' (deoxyribonucleic acids, or genetic material) means a compound (a 'nucleotide') of bases, sugars ('deoxyribose') and phosphoric acid which ultimately takes the shape of a double helix. Here, there are four types of bases: adenine (A), guanidine (G), cytosine (C), and thymine (T). Also, DNA arrays exploit DNA's complementarities for testing and analysis.

Proteins are essential principal components of biological cells and are a collective name for polypeptides, which are heavy compounds formed by polypeptide bonding between 20 types of L-amino acids. Proteins are biopolymers with a variety of molecular weights, structures and functions.

Also, an ejection head in a micro-array manufacturing apparatus means an ejection head for ejecting very small liquid droplets by the ink-jet method, just as in an ink-jet head.

The micro-array manufacturing apparatus according to this invention is the above-mentioned ink-jet printing apparatus for manufacturing micro-arrays by the ink-jet method.

A micro-array manufacturing apparatus of the present invention comprises; a carriage being movable in at least one direction on a stand; a plurality of cartridges, each storing a liquid, including an ejection head provided at its tip portion for ejecting the liquid by an ink-jet method, and being detachably mounted on the carriage; a table for mounting a micro-array substrate; and a suction means being mounted on the stand so as to be raised or lowered while the carriage is in the housing position, wherein the suction means includes a suction cap connected to a pump, and a gas-permeable filter supported by the suction cap to be brought into contact with the bottom face of the carriage.

Since the ink-jet method allows spotting of liquid samples in quantities of several picoliters at extremely precise locations, it is quite well suited for micro-array manufacturing apparatuses, which must create an extremely large number of types of probe samples with a high precision of location. Micro-arrays can be manufactured rapidly by using replaceable cartridges as the tanks for holding solutions of biological molecules. Handling is further speeded by unitizing the ink-jet-style ejection head with this cartridge. This further improves cost performance. Also, plural ejection heads can be filled with the ejection liquid quickly and in a single operation.

In the micro-array manufacturing apparatus according to the present invention, the gas-permeable filter is supported by a flexible sheet having a plurality of ventilation holes.

Since it is necessary to bring the gas-permeable filter into close contact with the lower face of the carriage (also called the 'cartridge holder'), as described above, it is preferable to support the filter with a flexible sheet having a plurality of ventilation holes, in order to obtain a uniform contact.

It is desirable for the suction means to be of unitary construction, and for the ejection head to be composed of a multiple reservoir head with multiple ejection components and multiple reservoir tanks.

The table may be fixed, but it is more desirable for it to be movable in a direction at a right angle to the moving direction of the carriage.

BRIEF DESCRIPTION OF THE DRAWINGS

FIG. 4 (B) shows the filling method of a liquid according to the present invention.

FIG. 7 (B) is a view of a lower face of the cartridge.

DETAILED DESCRIPTION

EMBODIMENT 1

Figure 1:
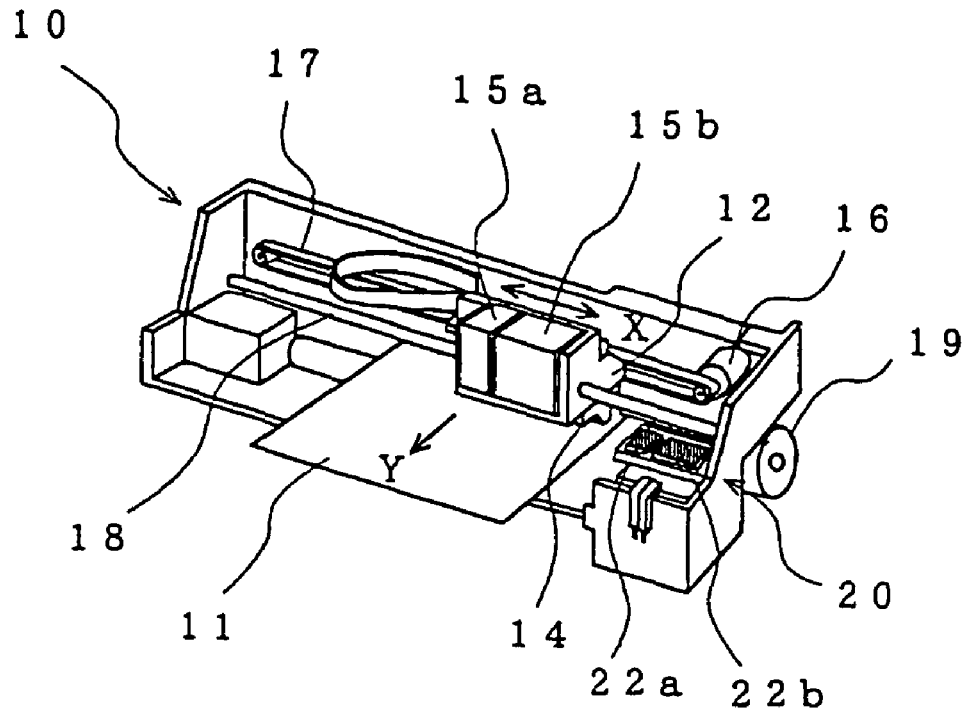
FIG. 1 is a schematic perspective view of an ink-jet printing apparatus according to this invention.

The first embodiment of this invention, the ink-jet printing apparatus, will be described. FIG. 1 shows a schematic diagram of the overall construction of the ink-jet printing apparatus.

In FIG. 1, the entire ink-jet printing apparatus, indicated by the number 10, contains a cartridge 12, which can move in both directions along an X axis (a principal scan direction), perpendicular to a Y axis (a secondary scan direction), which is a paper feed direction of a printing paper 11. This carriage 12 is provided with an ejection head (called an 'ink-jet head' in this embodiment) 14 and a tank, i.e., an ink cartridge 15, which supplies an ink to the ink-jet head 14. Here, the ink-jet cartridge 15 is a cartridge-type liquid tank containing only ink, which is a separate component from the ink-jet head and detachably mounted on the cartridge 12 equipped with the ink-jet head 14.

The carriage 12 is fixed to a timing belt 17, which is moved by a carriage motor 16. The carriage 12 is guided by a guide bar 18, so as to move back and forth in the direction parallel to the axis of a platen 19, i.e. the direction along the principal scan direction X.

The ink-jet head 14 is attached to the carriage 12 on the side facing the printing paper 11. The ink cartridge (ink tank) 15 for supplying ink to the ink-jet head 14 is detachably mounted on the upper part of the carriage 12. The ink-jet head 14 is divided into a black ink ink-jet head 14*a* for printing text and a color ink printing head 14*b* for color printing. Correspondingly, there are two kinds of ink cartridges 15, a black ink cartridge 15*a* and a color ink cartridge 15*b*. Each head 14*a*, 14*b* is supplied its corresponding ink from the black ink cartridge 15*a* or color ink cartridge 15*b*, and printing is done by ejecting ink drops onto the printing paper 11.

Figure 2:
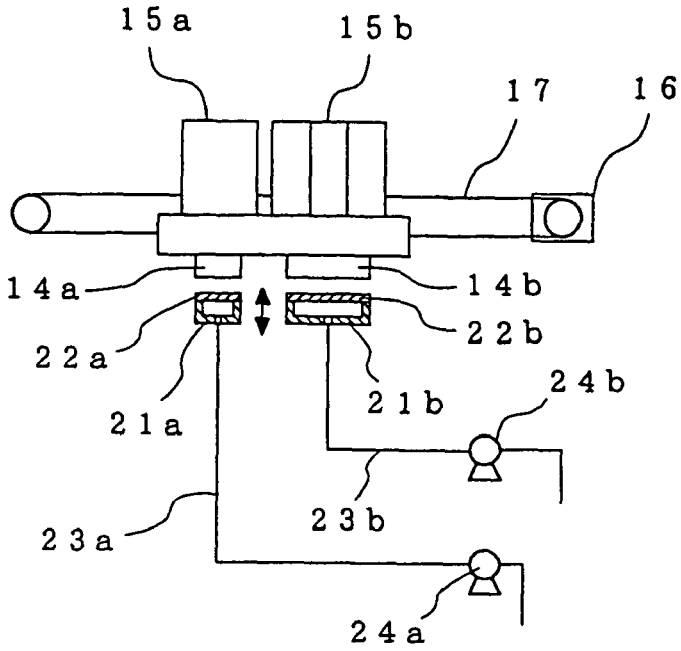
FIG. 2 is a schematic diagram of a suction means for filling with ejection liquids.

A suction means 20 for filling of an ejection liquid (an ink) is located in a home position (housing position), which is the non-ejection region (non-printing region) outside a printing region. A suction cap 21*a* for the black ink ink-jet head 14*a* and a suction cap 21*b* for the color ink ink-jet head 14*b* are located here, as shown in FIG.2, and gas-permeable filters 22*a* and 22*b* are attached with glue or other means to the front surfaces (upper surfaces) of the suction caps 21*a* and 21*b*. The gas-permeable filters 22*a* and 22*b* have the appropriate sizes (areas) for contact with the corresponding nozzle opening faces (head tip faces) on the ink-jet heads 14*a* and 14*b*. Also, the gas-permeable filters 22*a*, 22*b* have the characteristic of being passed by air while being passed by liquid under a pressure below a certain level. Specifically, it has been confirmed experimentally that it is desirable for them to be made of fine polytetrafluoroethylene (PTFE) fibers and to have a mean pore diameter of 1–3 $\mu$m. Also, the thickness of the gas-permeable filters 22*a* and 22*b* is about 0.3 mm.

The suction caps 21*a*, 21*b* are connected to the pumps 24*a*, 24*b* via the tubes 23*a*, 23*b* or other means. Since the suction means 20 consisting of the suction caps 21*a*, 21*b* with the gas-permeable filters 22*a*, 22*b* and the pumps 24*a*, 24*b* connected to the suction caps 21*a*, 21*b* via the tubes 23*a*, 23*b* or other means is constructed as a unit, and can be raised or lowered. Also, only the suction caps 21*a* and 21*b* may be capable of being raised or lowered respectively or together. Further the suction caps 21*a*, 21*b* may be combined into a single unit. A mechanism for raising or lowering the suction means 20 is not shown, but previously known means such as cylinders or ball-screws can be used for the mechanism.

Figure 3:
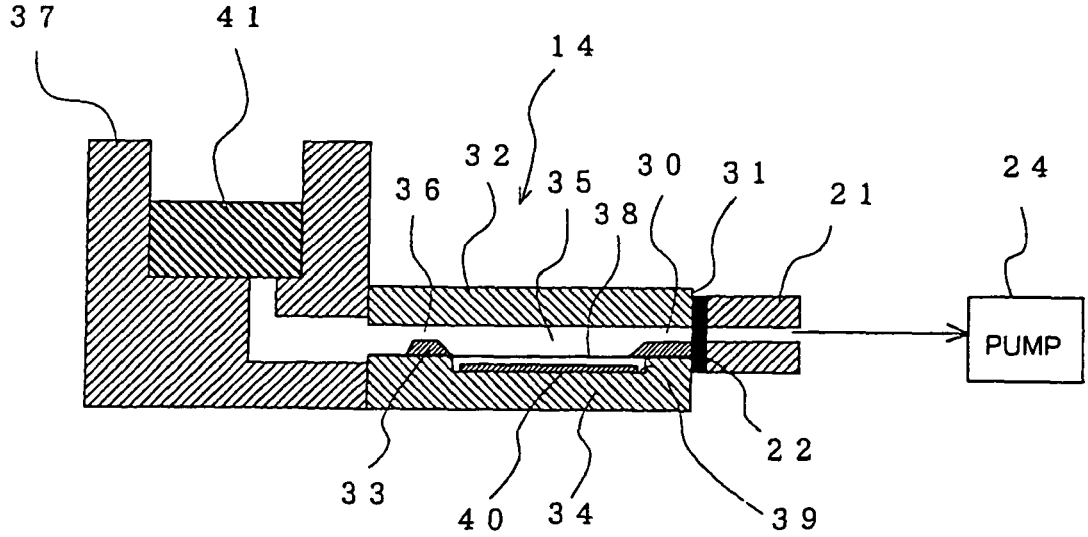
FIG. 3 is a schematic diagram showing a method for filling an ink-jet head with a liquid.

FIG. 3 is a schematic diagram showing a method for filling the ink-jet head 14 with ink. The FIG. also shows a single nozzle in the ink-jet head.

The ink-jet head 14 generally has multiple nozzles 30. The nozzles 30 are arranged at a constant pitch with a spacing of, for example, 0.5 mm. The ink-jet head 14 in FIG. 3 has an upper glass substrate 32, a Si substrate 33 in the middle and a lower glass substrate 34. These components are bonded each other by anodic bonding. The nozzles 30, an ejection chamber 35, an orifice 36, and a reservoir tank (ink chamber) 37, which constitute an ink flow path, are preformed by etching on the Si substrate 33. The bottom of the ejection chamber 35 is an oscillating plate 38 for ejection of ink droplets.

A concave portion 39 is formed on the lower glass substrate 34, and the actuator electrode 40 is formed on the concave portion 39 at a certain distance from and facing the oscillating plate 38. The oscillating plate 38 is forced to move according to static attraction force generated by connecting the actuator electrode 40 to the Si substrate 33 via the drive circuit (not shown) and driving it. This reduces the volume of the ejection chamber 35, causing ink to be ejected from the nozzle 31; the mechanism is arranged so that when the ejection chamber 35 is re-expanded to the original volume, the ink in the reservoir tank 37 is drawn in through the orifice 36. Also, a piezoelectric actuator may be used in place of the electrostatic actuator in the method for driving the oscillating plate 38.

The ink cartridge 15 is detachably mounted on the ink-jet head 14 with a bracket (not shown) and serves as the ink tank for an ejection liquid (ink) 41.

When the ink-jet head 14 is filled with an ink 41, the suction caps 21 are pressed against the nozzle opening faces (head tip faces) 30 with intervention of the gas-permeable filter 22 at the nozzle openings 31 for a tight seal.

The procedure for filling the flow path of the ink-jet head 14 with the ink 41 from the ink cartridge 15 or the reservoir tank (ink chamber) 37 is as follows.

(1) First, the carriage 12, shown in FIG. 1, is moved in order to locate the ink-jet head 14 at the home position (housing position) at non-printing region.

(2) The suction means 20 is raised such that the suction caps 21 are forced against the entire nozzle opening face 31 of the ink-jet head 14 with intervention of the gas-permeable filter 22.

(3) The pump 24 is activated and the air in the suction caps 21 is removed for a specified time period. As explained below, this causes ink in the ink cartridge 15 or the reservoir tank 37 to be drawn into all the flow path of the ink-jet head 14, completely filling the nozzles 30 up to their tips.

(4) Once the specified suction time has passed, the pump is stopped and the pressure in the suction caps 21 is returned to atmospheric pressure.

(5) The suction caps 21 are removed from the nozzle opening faces 31 thereafter and the suction means 20 is lowered to its original position. The ink-jet head 14 is then set to the standby condition for printing.

Figure 4A:
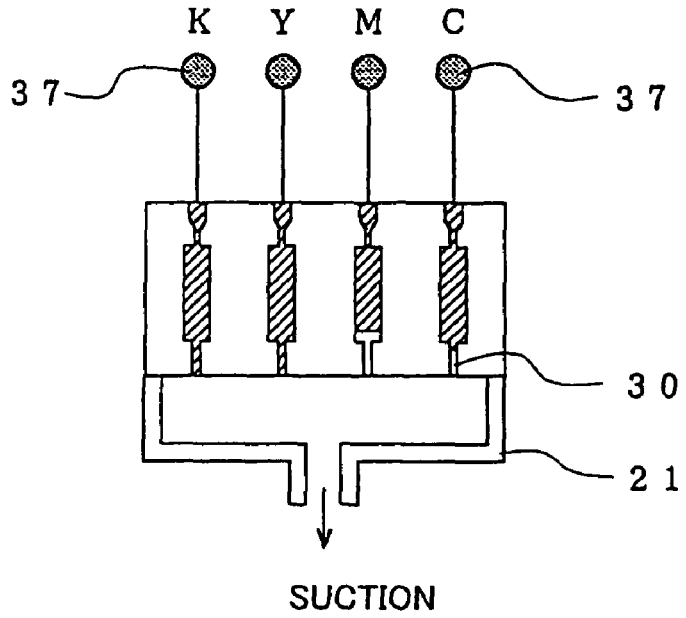
FIG. 4 (A) shows a conventional filling method of a liquid.
Figure 4B:
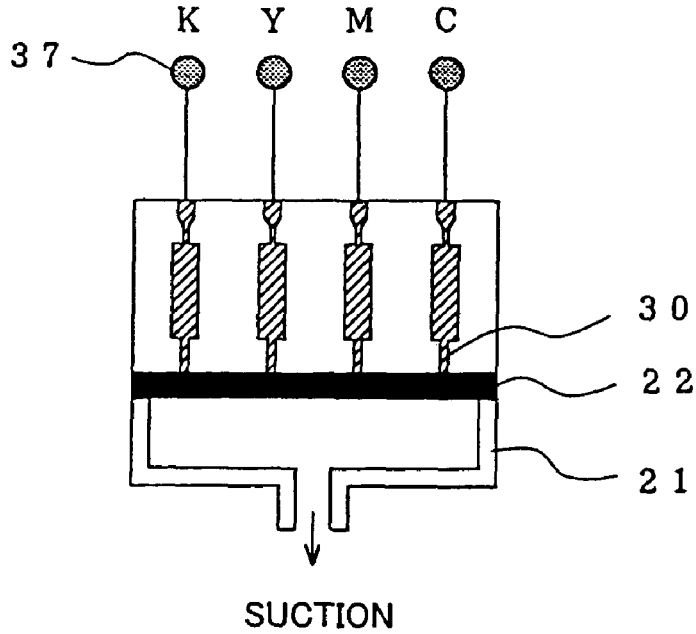

Here, the filling method of a liquid according to the present invention is described in comparison to the conventional method, with reference to FIG. 4 (A) and (B). FIG. 4 (A) shows a conventional filling method of a liquid and FIG. 4 (B) shows the filling method of a liquid according to the present invention. There are four types of reservoir tanks 37 in FIG. 4 (A) and (B), black (K), yellow (Y), magenta (M) and cyan (C).

Since there is no gas-permeable filter in the conventional method, when a negative pressure is established in the suction cap 21 with the suction pump, the respective inks from, for example, the black (K) and yellow (Y) tanks are drawn into the respective nozzles 30 up to the tips, but, for example, the inks from the magenta (M) and the cyan (C) proceed through the flow paths at differing speeds, due to variation in the dimensions of the flow paths, in ink viscosity, and in other factors, so that the flow paths are only partly filled.

When suction is maintained in order to completely fill the flow paths of nozzles 30 for inks from the magenta (M) and cyan (C), excess black (K) and yellow (Y) inks are released from the nozzles. Thus, in the conventional method, wasteful inks are apt to be released.

On the other hand, in the present invention, air is removed through the gas-permeable filters 22, so that they fulfill serves as a stopper for the liquid and prevent passage of the black (K) and yellow (Y) inks in the above example. Since the effect of the negative pressure in the suction caps 21 is then concentrated upon the nozzles 30 for the magenta (M) and cyan (C) inks, which have lower flow speeds, the negative pressure can draw the magenta (M) and cyan (C) inks up to the tips of the nozzles 30 quickly. At the same time, since only a gas is allowed to pass the gas-permeable filters 22, air bubbles in the flow paths can be completely drawn (evacuated).

Consequently, according to this invention, wasteful release of ink is prevented and an ink into all the flow paths of the ink-jet head 14 can be filled with the inks.

As mentioned above, the gas-permeable filters 22 have the characteristic of permeability of a gas while not of liquid under the pressure below a certain level. They are made of, for example, fine polytetrafluoroethylene (PTFE) fibers and have a mean pore diameter of 1 to 3 μm. The reason for the pore diameter to be 1 to 3 μm is, when the diameter is less than 1 μm, the speed of gas removal is made slow, resulting in prolonging suction time, and the ability to block a liquid by the gas-permeable filters 22 is lost when the pore diameter is greater than 3 μm. In the latter case, the liquids can bleed through the filters, and there is a risk that they will adhere to the edges of the nozzle openings. Thus, it is preferable to use non-hydrophilic(hydrophobic) substances for the gas-permeable filter 22.

In the example shown in FIG. 1, as mentioned before, the suction means 20 are divided into multiple branches, for black ink and for color ink. This is because black ink is usually consumed in far greater quantities than color ink. Such structure is not always necessary. For example, the suction caps 21*a*, 21*b* could be combined into a single suction cap.

EMBODIMENT 2

Figure 5:
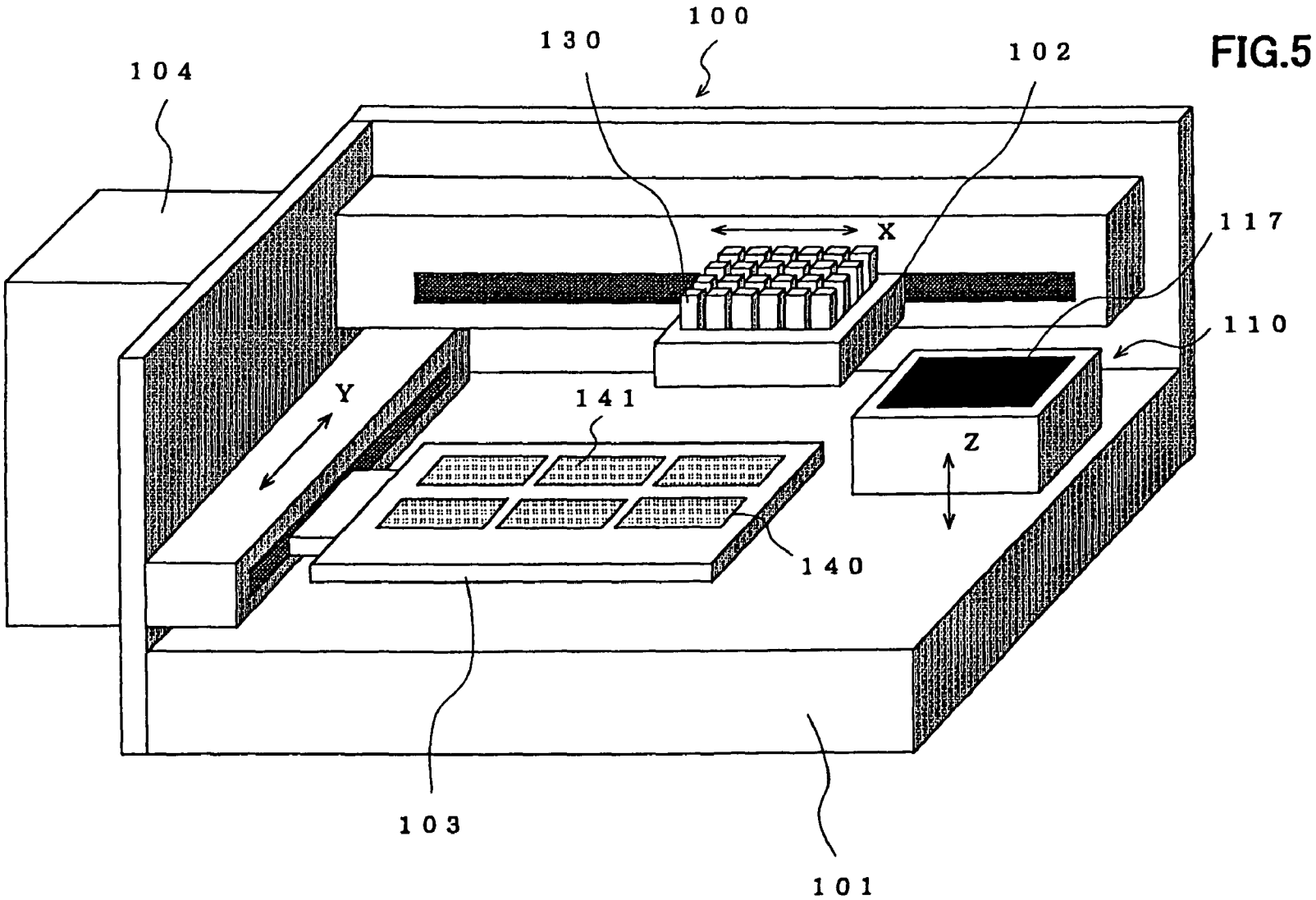
FIG. 5 is a schematic perspective view of the micro-array manufacturing apparatus according to this invention.
Figure 6:
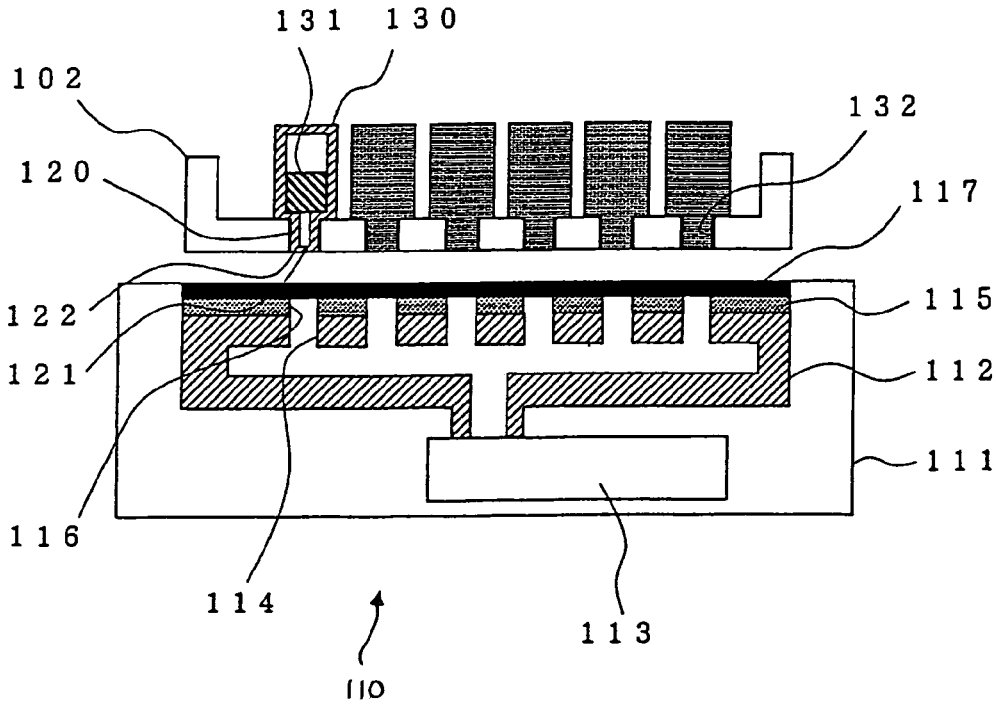
FIG. 6 is a schematic diagram of suction means for filling with ejection liquids and cartridges with ejection heads in a micro-array manufacturing apparatus.

Next, an apparatus for manufacturing a micro-array based on a ink-jet method will be described. FIG. 5 is an overall perspective view of an apparatus for manufacturing a micro-array according to the present invention, and FIG. 6 is a schematic diagram showing a suction means for filling ejection heads with ejection liquids and cartridges with the ejection heads used in the manufacturing apparatus.

A micro-array manufacturing apparatus 100 includes: a cartridge holder (carriage) 102, which can move back and forth along an X axis on a stand 101; a table 103, which can move along a Y axis, at a right angle to the X axis; and a suction means 110 for filling the ejection heads with the ejection liquids, which is provided at a home position of the cartridge holder 102 (a housing position outside the region in which the table 103 can be moved). In FIG. 5, a driving unit 104 for driving the cartridge holder 102 and the table 103, which can move them by numeric control using, for example, the timing belt mechanism shown in FIG. 1, a ball-screw mechanism, etc.

A plurality of cartridges 130 having ejection heads 120 on their tip ends (lower ends) are detachably mounted abreast on cartridge holder 102. A different type of ejection liquid 131 is contained in each cartridge 130 (for example, a solution of biological molecules). Practically, a rubber tank holding an ejection liquid is contained in the cartridge 130. Here, each cartridge 130 has a unitary construction composed of a tank holding an ejection liquid and an ejection head 120 for ejecting the liquid by the ink-jet method, and is detachably mounted as a cartridge on the cartridge holder (carriage) 102.

A plurality of micro-array substrates 140 made of glass or other substances are placed on the table 103. There is no particular limit to the number of micro-array substrates 140. Groups 141 of micro-array, such as DNA chips, can be manufactured by ejecting the liquids from the cartridges 130 or the reservoir tanks through the nozzles 121 of the ejection heads 120 by the ink-jet method.

As shown in FIG. 6, the suction means 110 comprises a suction cap 112 located inside a unit case 111 and a pump unit 113 directly connected to the suction cap 112 via a manifold. The suction cap 112 is constituted by a box-shaped structure provided with multiple suction holes 114 along its top surface, which are aligned with the ejection heads 120 of the cartridge 130. The suction holes 114 are formed with the same spacing as the cartridges 130. In addition, an elastic sheet 115, of rubber or another material, with ventilation holes 116 provided at approximately the same positions as the suction holes 114, is placed on the suction cap 112. This supports a gas-permeable filter 117, which lies atop and is point-bonded to the elastic sheet 115 or attached by another means. The suction means 110 can be raised or lowered, in the Z direction, by a mechanism, which is not shown. Previously known means such as cylinders or ball-screws can be used for the mechanism to raise and lower the unit case 111.

The gas-permeable filter 117 is similar to the gas-permeable filter 22 described in the first embodiment. Also, the gas-permeable filter 117 is made to be in contact completely with the lower face of the cartridge holder 102. In other words, it has sufficient area to cover the nozzle opening faces (head tip faces) 122 of all the cartridges 130 mounted in the cartridge holder 102. Therefore, the elastic sheet 115, made of rubber or another material having elasticity, is placed between the gas-permeable filter 117 and the suction cap 112, in order to assure uniform contact between them in the case, when the gas-permeable filter 117 is pressed against the bottom of the cartridge holder 102.

Figure 7A:
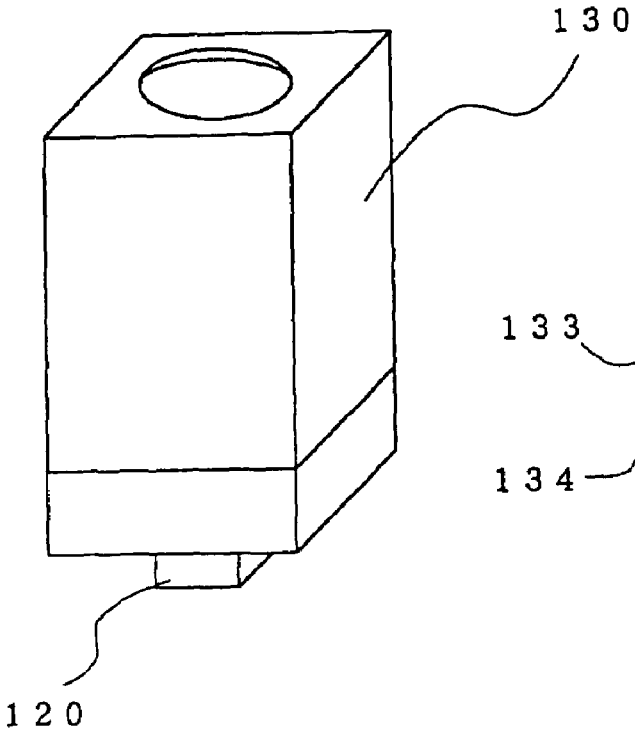
FIG. 7 (A) is an expanded perspective view of a cartridge with an ejection head.
Figure 7B:
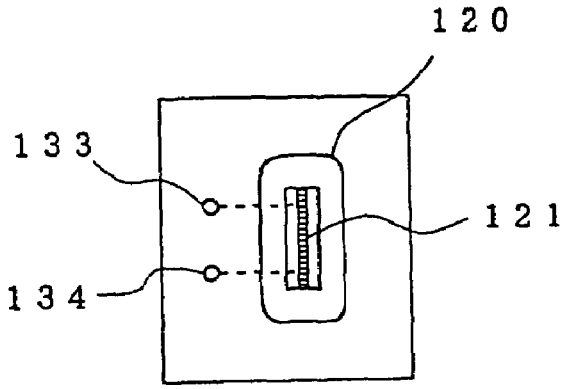

Each cartridge 130 is so arranged as to have an ejection head 120 at its tip (lower end), as shown in the expanded view in FIG. 7. Multiple through holes 132 to fit the ejection heads 120 of the cartridges 130, are provided abreast with a given spacing in the cartridge holder 102. Nozzle opening faces (head tip faces) 122 of the cartridges 130 are arranged so as to meet substantially with the lower face of the cartridge holder 102.

Figure 8:
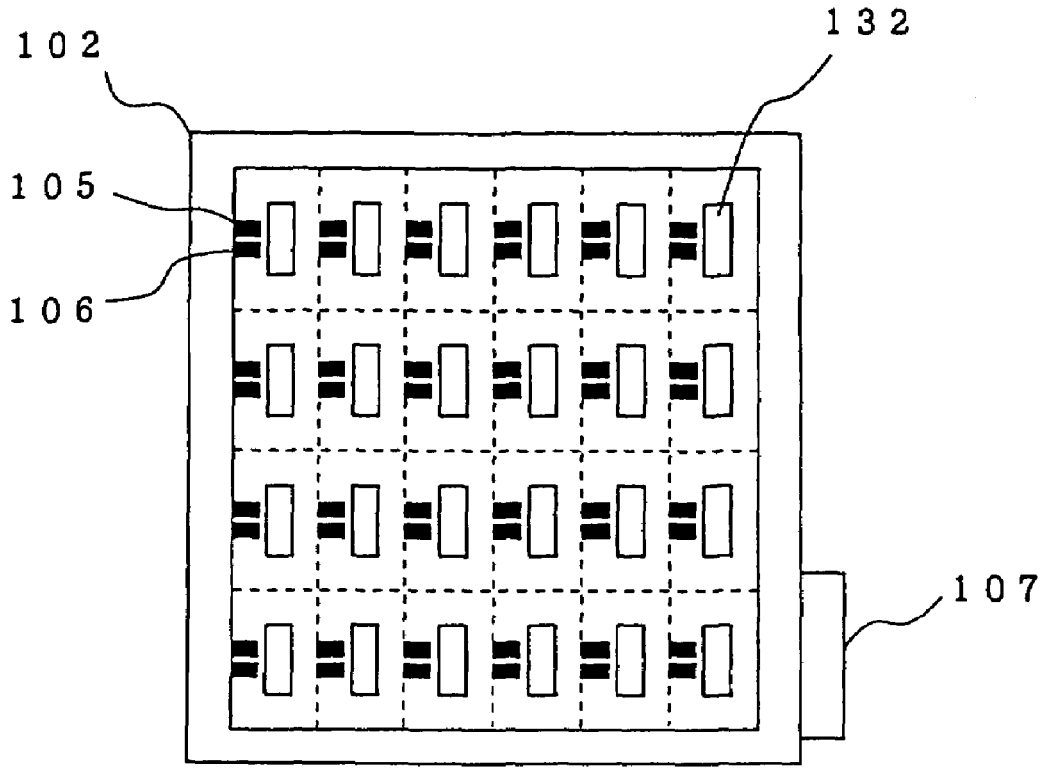
FIG. 8 is a plan view of a cartridge holder.

FIG. 8 is a plane view of the cartridge holder 102 as seen from above. Electrodes 105, 106 are arranged on the upper surface of the cartridge holder 102 near each through hole 132. Contacts 133, 134 to be brought in contact with the electrodes 105, 106 are provided on the lower face of the cartridge 130 (see FIG. 7) and they are connected to the actuator electrodes for driving oscillating plates of the ejection heads 120. One contact 133 is connected to a common terminal shared by the actuator electrodes for respective head chips, shown in FIG. 3, and the other 134 is connected to a terminal shared by an Si substrate making up an oscillating plate of each head chip. In FIG. 8, 107 indicates a connector linked to each electrode 105, 106.

Thus, by inserting the ejection head 120 of the cartridge 130 into the through hole 132, electrical connection is made, enabling each ejection head 120 to be driven by the ink-jet method.

Figure 9:
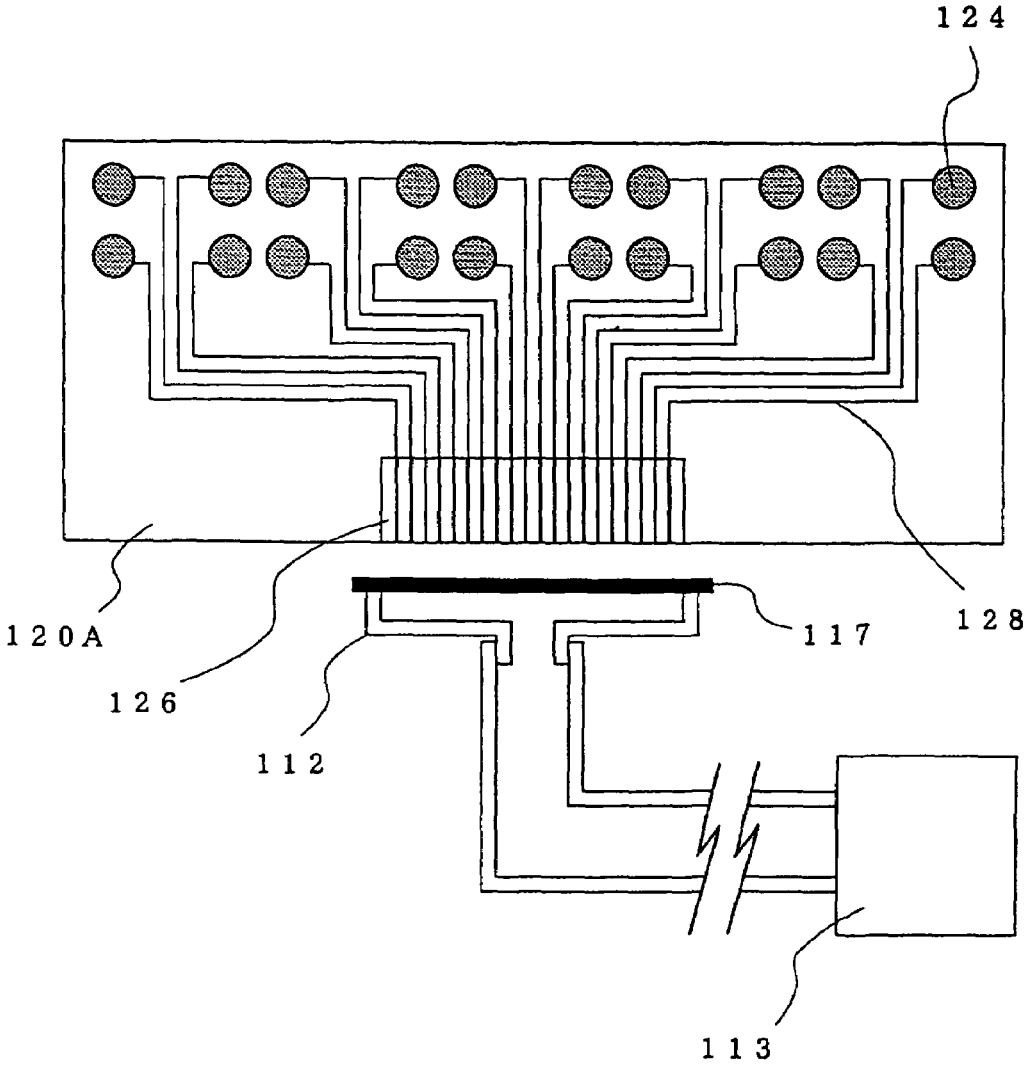
FIG. 9 is a schematic diagram showing multiple reservoir heads and a method for filling them with liquids.

FIG. 9 is a schematic diagram showing the construction of the multiple reservoir heads and a method of filling the heads with liquid. The suction means 110 for filling the heads is simplified in this diagram; a unit type construction shown in FIG. 6 is practically preferable.

An ejection head 120 attached to the tip end (lower end) of each cartridge 130 may have a single nozzle, but it is usually preferred to use multiple reservoir heads constituted by multiple nozzles, in order to manufacture several thousand or several tens of thousands of micro-arrays in a short time. Consequently, multiple reservoir heads 120A containing multiple reservoir tanks 124 are provided. In FIG. 9, 126 indicates an ejection component comprising an ejection chamber, an oscillating plate, an actuator electrode and other components as shown in FIG. 3. A flow path of a liquid is denoted by 128.

The method of filling heads with liquids in this embodiment is described using FIG. 5 and FIG. 6.

First, a cartridge holder 102 equipped with cartridges 130 with ejection heads 120, is moved in an X direction to a home position, where it is stopped directly above a suction means 110. Next, the suction means 110 is raised and the suction cap 112 is forced against and brought in contact with the lower face of the cartridge holder 102 via a gas-permeable filter 117 and an elastic sheet 115. At the same time, a pump unit 113 is activated to obtain negative pressure in the suction cap 112.

By this process, the air within nozzles 121 of respective ejection heads 120 is drawn through the gas-permeable filter 117, ventilation holes 116 of the elastic sheet 115, and suction holes 114 of the suction caps 112. Each ejection head 120 and nozzle 121 can then be filled up to the tip with each ejection liquid 131 in the respective cartridge 130.

In the case of the multiple reservoir heads 120A as shown in FIG. 9, the flow path of each rejection head 120 can be filled to the tip of each nozzle 121 with the ejection liquid 131 from each of all the reservoir tanks 124 in a single operation.

Because the gas-permeable filter 117 allows air to pass therethrough but stops liquid, as mentioned previously, it can prevent release of the ejection liquid; consequently, wasteful release of small volumes of expensive biopolymer solutions is completely eliminated. Even if the lengths of the flow paths 128 are different, the suction pressure acts on each nozzle 121 and no problem is caused. In addition, it is also possible to completely remove air bubbles in the flow paths 128.

In the construction of the first embodiment, the gas-permeable filter is directly attached to the tip face of the suction caps. However, in order to maintain a close contact with the nozzle opening faces, it is allowed to change the construction to seal with a porous elastic sheet, as shown in FIG. 6.

Also, in the second embodiment, the table may be fixed. In this case, the carriage, i.e., the cartridge holder, has to be made movable along both the X and Y axes.

As described above, this invention enables filling of the ejection heads without waste of the ejection liquids during a priming operation, because the suction caps is brought in close contact with the nozzle opening faces of the ink-jet heads or the ejection heads through the gas-permeable filter, subsequent to which, suction is applied. Particularly, it is possible to carry out filling with ejection liquids of small volumes of expensive biopolymer solutions without wasteful release during manufacture of micro-arrays, and multiple ejection heads can be filled with the ejection liquid quickly and in a single operation.

The entire disclosure of Japanese Patent Application No. 2002-225589 filed Aug. 2, 2002 is incorporated by reference.

What is claimed is:

1. An apparatus for manufacturing a micro-array, comprising:

a carriage that is movable in at least one direction on a stand;

a plurality of cartridges detachably mounted on the carriage, each cartridge storing a liquid and including an ejection head provided at a tip thereof for ejecting the liquid by an ink-jet method;

a table supporting a micro-array substrate relative to the carriage to enable manufacturing of a micro-array by ejecting drops of the liquid; and a suction unit mounted on the stand so as to be raised or lowered while the carriage is in a housing position;

wherein the suction unit includes:

a suction cap connected to a pump;

a gas-permeable filter supported by the suction cap, the gas-permeable filter being contactable with a face of the carriage, said gas permeable filter allowing a gas to pass therethrough and preventing the liquid from passing therethrough; and an elastic sheet having a plurality of suction holes formed therein interposed between the gas-permeable filter and the suction cap.

2. The apparatus for manufacturing a micro-array claimed in claim 1, wherein the suction unit is of unitary construction.

3. The apparatus for manufacturing a micro-array claimed in claim 1, wherein the ejection head further comprises a multi-reservoir head including a plurality of ejecting portions and a plurality of reservoir tanks.

4. The apparatus for manufacturing a micro-array claimed in claim 1, wherein the table is movable in a direction perpendicular to the moving direction of the carriage.

* * * * *